US005452665A

United States Patent [19]

Wronkiewicz et al.

[11] Patent Number: 5,452,665

[45] Date of Patent: Sep. 26, 1995

[54] BOLSTER FRICTION SHOE POCKET WITH RELIEVED OUTER WALL

[75] Inventors: Robert D. Wronkiewicz, Park Ridge, Ill.; Thomas R. Schultz, Hammond, Ind.

[73] Assignee: AMSTED Industries Incorporated, Chicago, Ill.

[21] Appl. No.: 223,553

[22] Filed: Apr. 6, 1994

[51] Int. Cl.[6] ..... B61F 5/50

[52] U.S. Cl. ..... 105/198.2; 267/196

[58] Field of Search ..... 105/197.05, 198.2, 105/198.4; 267/196, 205, 209

[56] References Cited

U.S. PATENT DOCUMENTS

| | | | |
|---|---|---|---|
| 2,378,415 | 6/1945 | Light | 105/198.2 |
| 4,103,623 | 8/1978 | Radwill | 105/198.4 |
| 4,244,298 | 1/1981 | Hawthorne et al. | 105/197.05 |
| 4,276,833 | 7/1981 | Bullock | 105/198.5 |
| 4,637,319 | 1/1987 | Moehling et al. | 105/207 |
| 5,331,902 | 7/1994 | Hawthorne et al. | 105/198.2 |

*Primary Examiner*—Robert J. Oberleitner
*Assistant Examiner*—S. Joseph Morano
*Attorney, Agent, or Firm*—Edward J. Brosius; F. S. Gregorczyk; Thomas J. Schab

[57] ABSTRACT

A railway vehicle truck bolster friction shoe pocket includes a sloped rear wall and longitudinally spaced sidewalls depending from the rear wall to form a friction shoe pocket having open top and bottom ends for receiving a variable rate type of friction shoe. During rotation and translation of the bolster with respect to the truck sideframe, the outboard friction shoe pocket sidewall is repeatedly impacted by the outer and upper corner of the friction shoe. The impacting causes protuberances to form in the outboard sidewall, but only on the upper portion of the wall. The same sidewall is provided with a relieved section across the entire sidewall upper portion in order to eliminate the impact contact area between the upper portion of the friction shoe and the upper portion of the outboard sidewall. Eliminating the contact area eliminates the formation of protuberances and extends the life of the bolster.

4 Claims, 5 Drawing Sheets

BOLSTER FRICTION SHOE POCKET WITH RELIEVED OUTER WALL

BACKGROUND OF THE INVENTION

The present invention relates to an improved railway bolster friction shoe pocket of the type which is configured to receive a variable-rate, spring-damped friction shoe. With variable rate designs, a friction shoe is placed between each sideframe column and the adjacent truck bolster end such that compression of the shoe actuating spring varies during relative vertical motion between the sideframe and the bolster. More particularly, the present invention relates to a friction shoe pocket outer wall profile which will eliminate wearing protuberances that are caused by rotation and translation of the friction shoe within the shoe pocket and which prevent proper friction shoe displacement.

SUMMARY OF THE INVENTION

One purpose of the invention is to provide an improved profile for a bolster friction shoe pocket which will prevent the formation of protuberances at the upper, outside corner of the outer friction shoe wall during relative translation and rotation between the sideframe and the bolster.

Another purpose of the present invention is to provide a bolster member which, through utilization of a specific profile for the outer shoe pocket wall, eliminates jamming and cocking between the friction shoe and the bolster pocket.

BRIEF DESCRIPTION OF THE DRAWINGS

Further objects and advantages will become apparent upon reading the following detailed description in conjunction with the drawings wherein.

DETAILED DESCRIPTION OF THE INVENTION

This invention is particularly concerned with a type of railway car truck well known in the industry as the RideMaster® truck, manufactured by American Steel Foundries, Inc., a division of AMSTED Industries Incorporated of Chicago, Ill. It has been discovered that protuberances are being formed on the bolster friction shoe pocket outboard wall, specifically on the outer regions of the pocket and only on the upper half of the wall. Although it can be said that the bolster friction shoe pocket and accompanying friction shoe of the present invention has characteristics which are similar to the friction shoe and pocket shown in U.S. Pat. No. 4,637,319, to Moehling, it should be understood that the differences in shoe and pocket designs result with two dissimilar wearing or protuberance problems, even though they commonly occur on the friction shoe pocket outboard wall. The '319 patent was specifically directed to trucks which were similar to either the Barber® type of truck (Barber® is a registered trademark of Standard Car Truck Company, Park Ridge, Ill.) or the Ride Control® type of truck, sold by American Steel Foundries, Inc. (Ride Control® is a registered trademark of American Steel Foundries).

Figure 1:
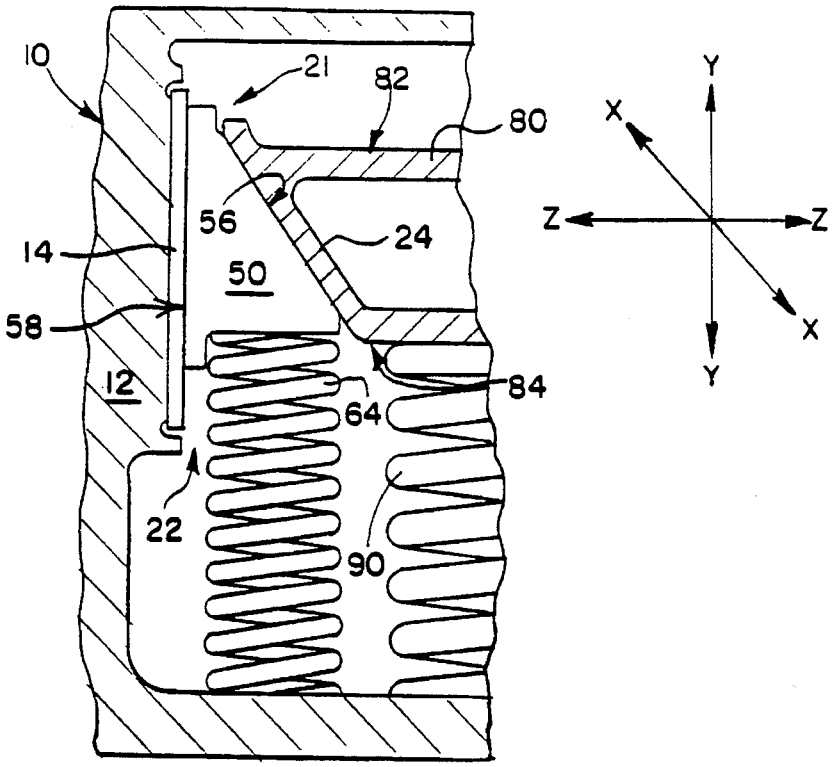
FIG. 1 PRIOR ART
FIG. 1 is a partial, cross-sectional side view showing the friction shoe of prior art in relation to the bolster.
Figure 1A:
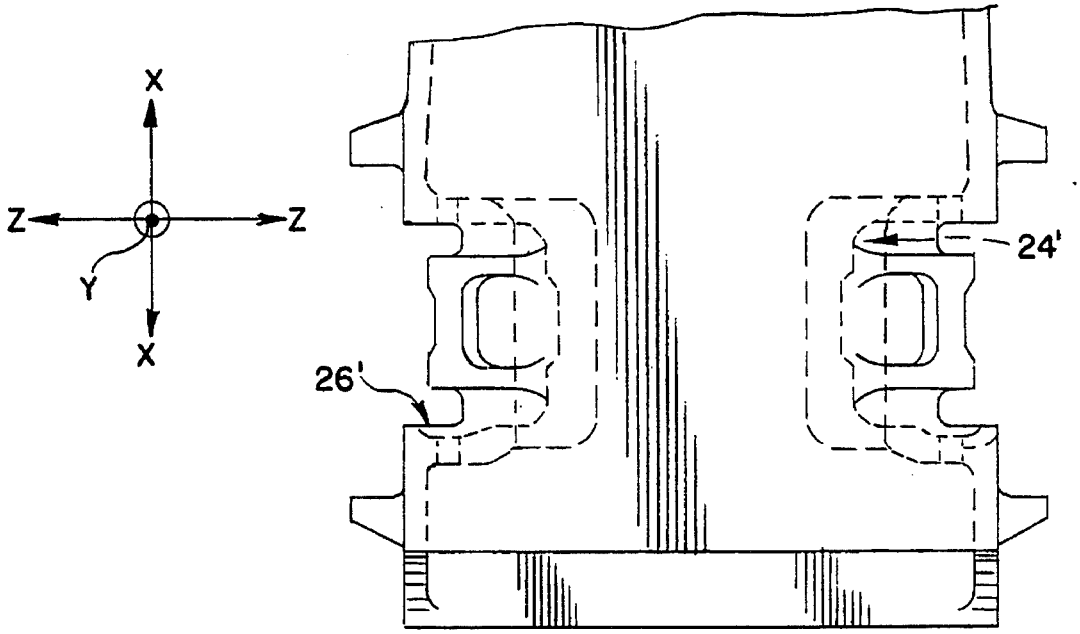
FIG. 1A PRIOR ART
FIG. 1A is a plan view of a prior art bolster showing the construction of the friction shoe pocket.

The configuration of the friction shoe pocket, as well as the friction shoe design of the '319 patent promotes limited lateral travel within the pocket, while allowing substantial vertical travel, as well as some rotational motion. The construction of the friction shoe pocket of the '319 patent can be seen in FIG. 1A. However, it should be understood that the arrangement of FIG. 1 is applicable to the friction shoe and pocket assembly of the present invention, as well as the '319 patent. The rotational motion tilts or rotates the shoe 50 towards the sideframe column 12 when the friction shoe pocket rear wall acts upon the slanted friction shoe rear wall during the upward motion of the friction shoe. The rotational motion corresponds to movement around the X axis, as illustrated in FIG. 1. The limited lateral movement occurs along the X axis (into the plane of the paper), and the vertical movement occurs along the Y axis. It was discovered that these types of combined shoe motions caused protuberance formations on the outboard wall of the friction shoe pocket, specifically at a point opposing a pinhole (not shown) included on the friction shoe sidewall, as will be explained in greater detail shortly.

Even though the present invention utilizes a generally wedge-shaped friction shoe with a variable-rate actuating spring, it is important to clarify that the RideMaster® friction shoe pocket differs from that of the '319 patent, and for that matter, so does the friction shoe. It is generally believed, although not fully understood how, that the present friction shoe pocket design contributes to the formation of the previously-mentioned protuberances on the upper portion of the outboard pocket sidewall. It is believed that the friction shoe is either undergoing a purely rotational or axial movement about the Y axis, or it is undergoing a combination of part Y axis rotation, Z axis rotation, and part X axis translation. In either case, it is known that the motion of the shoe which causes the protuberances is unique to the RideMaster® truck and it is not present in the trucks featured in the '319 patent. It is believed that the problem solved by the present invention is the result of the friction shoe pocket rear wall 24 (FIG. 2) being formed from two sloping or angled surfaces meeting at a peak. As seen from comparing FIG. 1A and FIG. 2, the dual, rear wall construction of the RideMaster® truck of differs from the single-surface, sloped rear wall 24' of the '319 friction shoe pocket. It is further believed that since the friction shoe wedge wall 56 of the present shoe is complementary to the friction shoe pocket rear wall 24, the rear wall acts as a means for promoting rotation of the shoe in all three directions. It is believed that the added play or tolerances developed with a dual-surfaced rear wall, allows the shoe the capability to rotate about the peak line, which generally corresponds to a rotation about the Y axis. The single-surface, rear wall design of the '319 patent (FIG. 1A) does not allow rotation with respect to the Y axis. As previously mentioned, shoe movement in the '319 design was laterally along the X axis, thereby engaging the outside wall 26', and also along the vertical or Y axis, thereby causing wear of the entire outside wall surface except in the area corresponding to the recessed pin hole (not shown) on the side of the friction shoe (not shown). As sidewall wearing progressed, a protuberance eventually developed on outboard sidewall 26', causing the shoe to jam during movement. The solution disclosed by the '319 patent was to relieve the protuberance area so that the entire outside pocket wall would wear evenly.

However, with the shoe and pocket design herein, the protuberances being formed are not the result of uneven sidewall wear, rather, they are formed as a result of the friction shoe impacting and gouging the outboard sidewall. As mentioned, the protuberances are being formed only on the outboard sidewall, and only on the upper half or extent 40 of the wall. Furthermore, the protuberances are limited to the area near the outboard edge 36 of the friction shoe pocket wall 32. The protuberances have been found substantial enough to prevent the retraction of the shoe in the friction shoe pocket, as well as proper damping of the bolster. Field inspection has determined that once the friction shoe cocks or rotates within the pocket, a large force is being applied by the upper corner or edge 62 of friction shoe 50 against the upper and outer portion of the friction shoe outside wall, namely at contact area 200, causing this area to initially wear. After wearing has progressed, the friction shoe is provided with additional free play or slack to impact the same area in dramatic, or impact fashion. The resultant stresses are of a magnitude above the yield point of the bolster material, causing the metal on the outside wall to gouge the sidewall material, thereby forming the protuberances. The congruent surface on the corner edge of the friction shoe, being of a stronger material than the bolster, will experience wear to a lesser degree.

Figure 2:
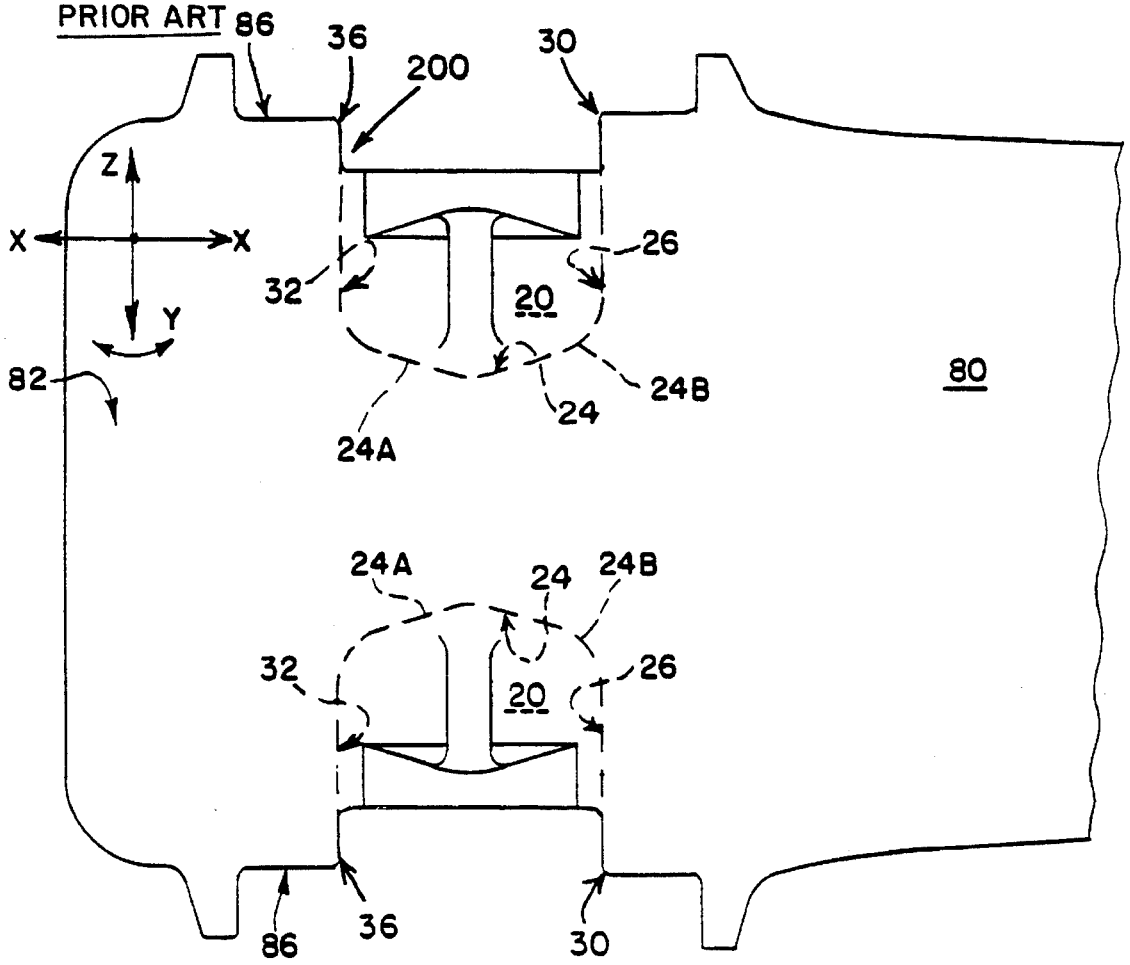
FIG. 2 PRIOR ART
FIG. 2 is a bottom view of a RideMaster® bolster showing the construction of the friction shoe pocket.
Figure 3:
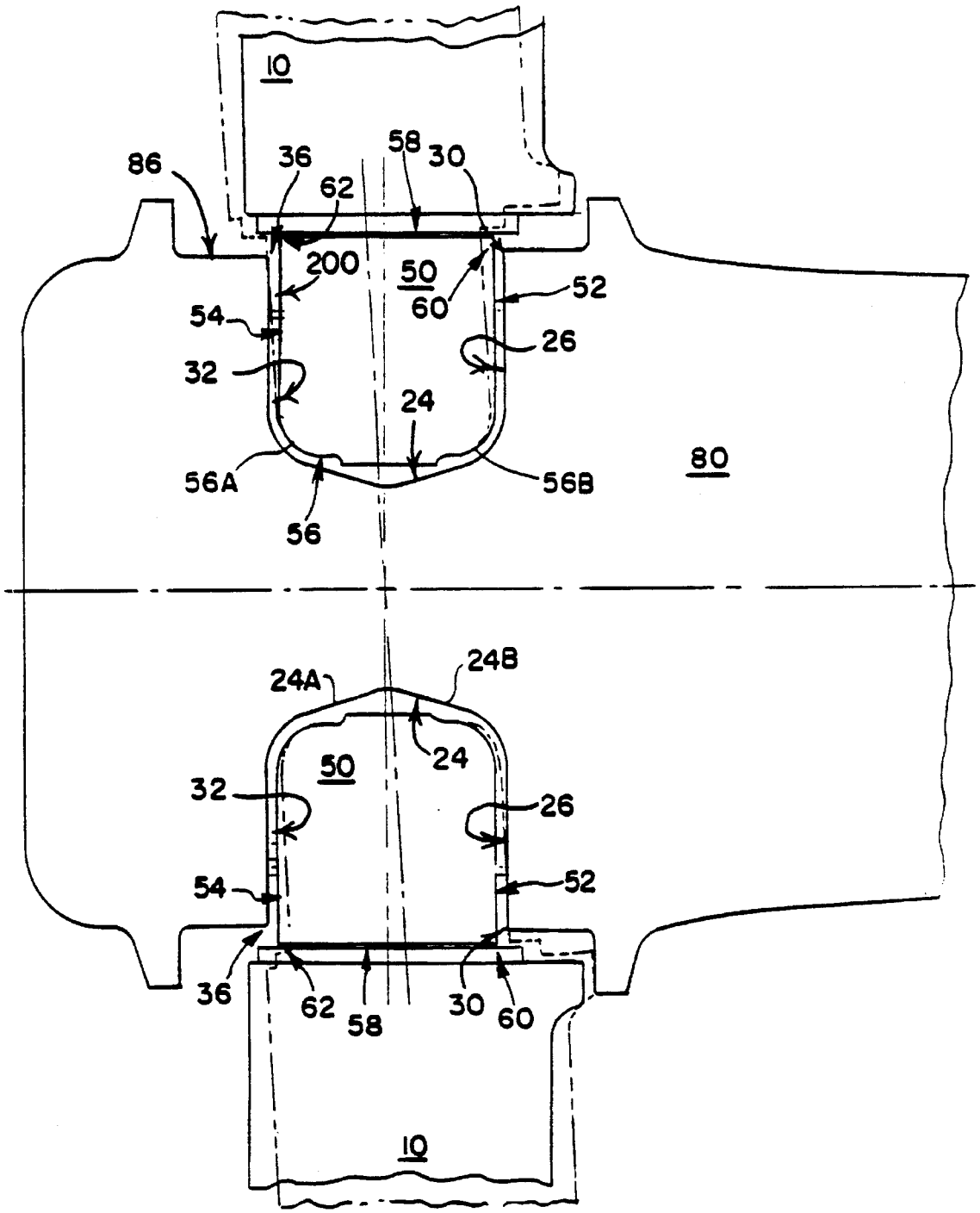
FIG. 3 is a diagrammatic illustration of the relative rotation between the RideMaster® bolster and sideframe during operation of the railcar, emphasizing the friction shoe cocking within the shoe pocket.

FIG. 1 is an illustration of the variable-rate type of friction shoe assembly in which the above failures occur. The sideframe is indicated at 10 and the bolster at 80. A friction member or shoe is indicated at 50 and has a generally triangularly shaped profile that is positioned within a complementary shaped bolster friction shoe pocket, which is best seen in FIG. 2 at 20. In that illustration, the friction shoe pocket is comprised of a first and second sidewall 26 and 32 depending transversely from a slanted rear wear wall 24 which provides a friction seat for a correspondingly slanted wedge wall 56 on the friction shoe. Rear wall 24 is comprised of two slanted halves, 24A and 24B, which meet at a peak. Likewise, friction shoe slanted wedge wall 56 (FIG. 3) is comprised of two slanted halves 56A and 56B, which are substantially complementary with the profile of friction shoe pocket rear wall 24. For the sake of clarity, it should be mentioned that the first friction shoe sidewall 26 is considered to be an inboard wall, while the second wall 32 is the outboard or outside sidewall.

Referring again to FIG. 1, friction shoe 50 has vertical wear wall 58 which frictionally engages wear plate 14 on sideframe vertical column 12. During vertical displacement of bolster 80, variable rate control spring 64 provides a snubbing force counteractive to the vertical oscillations of bolster 80, thereby dissipating the energy stored in the load spring groups 90 when friction shoe front face 58 rubs against sideframe column wear plate 14. Wedge wall 56 on friction shoe 50 interacts with slanted rear wall 24 of pocket 20 to maintain shoe 50 within pocket 20 during the vertical oscillations. The load spring group 90 generally supports and transfers the load of the railcar to the sideframes and performs no damping function.

During the vertical damping operation, friction shoe 50 is also guided laterally within the pocket by each of the friction shoe pocket sidewalls 26, 32. The initial tolerance (controlled slack) between the bolster sidewalls 26, 32 and the friction shoe sidewalls 52, 54, is maintained relatively close so that during relative sideframe-to-bolster rotation, the friction shoe 50 does not become easily cocked and/or jammed within the friction shoe pocket 20. Although some initial tolerance is necessary to install the friction shoe in the pocket, eventually, the friction shoe components will wear and the resultant development of free slack will cause the tolerances to grow. As the tolerances becoming larger, the friction shoe will eventually begin to experience some lateral rotation within the pocket as the sideframe and bolster rotate with respect to each other. As illustrated from FIG. 3, the outboard front corner 62 of the friction shoe 50 will rotate within the friction shoe pocket about the Y axis and contact outboard sidewall 32 at contact area 200. It should be realized that contact area 200 is the specific area defined from the midpoint 38, up to the top surface of bolster top wall 82. Upon each occurrence of the friction shoe becoming cocked, contact between the friction shoe and the bolster will increase the free slack developed, thereby increasing the magnitude of the impact forces with which the friction shoe 50 contacts sidewall 32 at contact area 200. Because the impact forces are so extreme, the yield strength of the bolster material will be exceeded, resulting in the protuberances previously described. As it should be clear, the protuberances lie vertically oriented along contact area 200, mainly from bolster top wall 82 to midpoint 38, on outboard sidewall 32, causing friction shoe 50 to become jammed in the friction shoe pocket.

It has been found that as long as protuberances do not occur before the truck is disassembled for maintenance, the friction shoe will operate free from jamming even if the outboard sidewall undergoes some wearing. However, there is no guarantee that a bolster friction shoe pocket will fail to develop protuberances until the maintenance period arrives. Therefore, the present invention is specifically designed to be a simple, yet effective approach towards eliminating the opportunity for the friction shoe to cause the mentioned protuberances. In this respect, many attempts to correct this problem have concerned themselves with redesigning the friction shoe itself; this has proved to be an overly complicated approach.

Figure 4A:
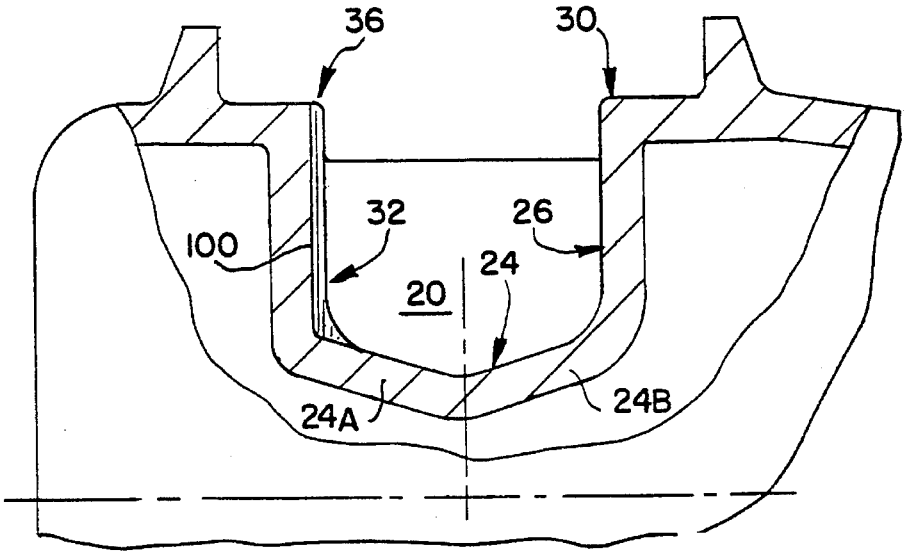
FIG. 4A is a top view of the bolster friction shoe pocket shown in FIG. 4 with the friction shoe pocket roof removed in order to clearly show the present invention.
Figure 4:
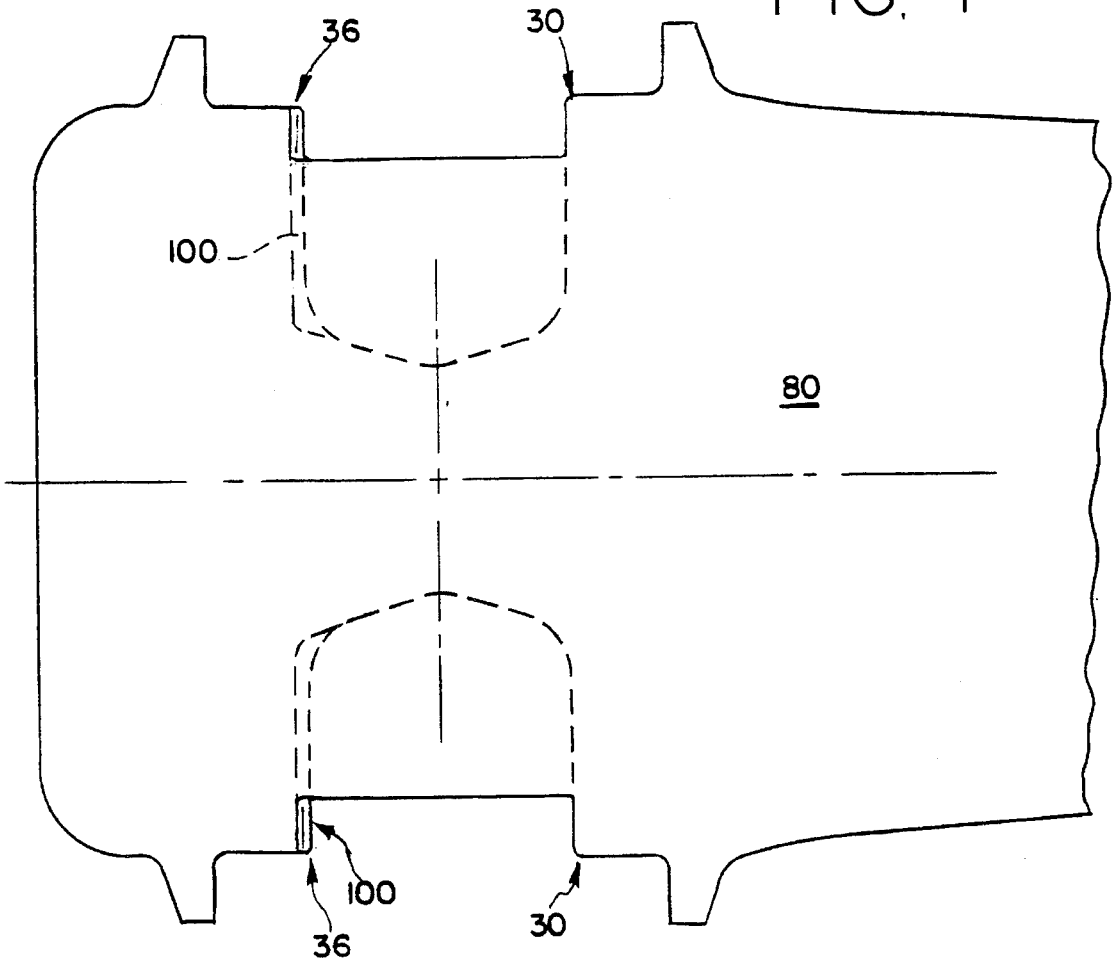
FIG. 4 is a plan view of a bolster of the present invention showing the relieved outer friction shoe pocket wall of the preferred embodiment.
Figure 5:
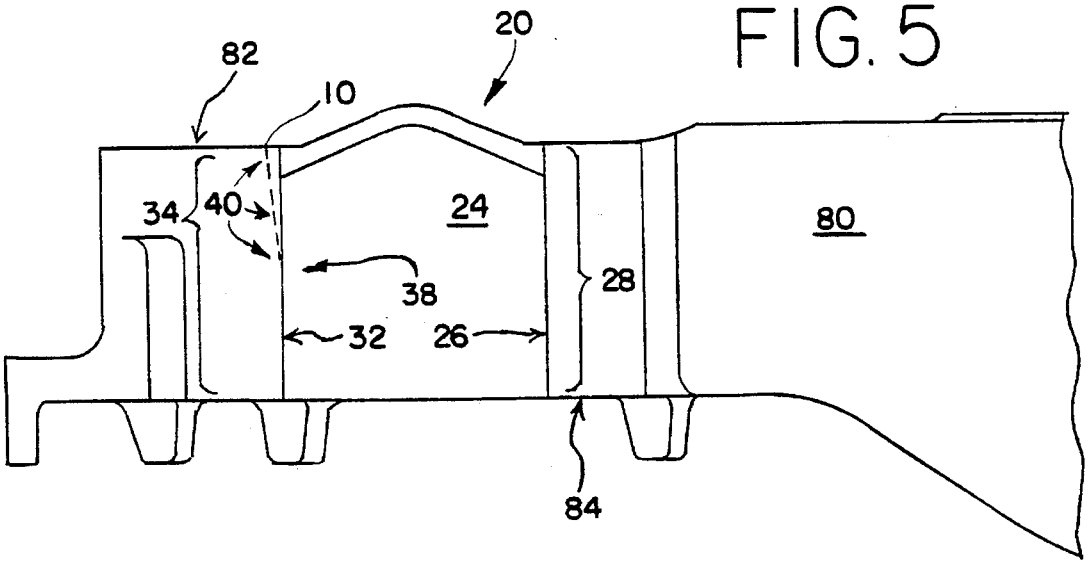
FIG. 5 is a side view of a bolster of the present invention showing the vertical extent of relieved section of the outer friction shoe pocket wall of the preferred embodiment.

The present invention on the other hand, provides a horizontally oriented, indentation 100 which is coincidental with the contact area 200, yet generally transverse to the vertical. As illustrated in FIGS. 4, 4A and 5, indentation 100 extends between friction shoe pocket rear wall 24 to bolster second front edge 36, while only projecting upwardly from the midpoint (38) between bolster bottom wall 84 and bolster top wall 82 to effectively only occur on the upper extent 40 of outboard wall 32. Indentation 100 preferably extends across the friction shoe pocket sidewall 32 in order to make coring simpler, although the indentation 100 would sufficiently serve the same purpose if it only extended across one half of the sidewall. Also seen from illustrations 4 and 5, the shape or profile of indentation 100 is in the form of a taper. The taper starts at midpoint 38, and extends upwardly and outwardly into sidewall 32, such that at the surface of top bolster wall 82, the indentation is the widest, preferably having at least 0.38 inches of inward extent, although the maximum extent of taper can be 0.50 inches.

By providing indentation 100, the outboard front corner 62 of friction shoe 50 will no longer be directly riding against contact point 200 since indentation 100 provides enough tolerance for corner 62 to translate and cock towards and against outside friction shoe wall 32 without destructively impacting the contact area. It should be understood, that the lower portion of friction shoe will still contact outer wall 32. However, since the top of shoe 50 undergoes a relatively greater angle of cocking within the friction shoe pocket as compared to the base of the shoe, the lower portions of the shoe will not impact the outer sidewall in a fashion severe enough to create protuberances. Therefore, there is no need to relieve the lower half of the outer wall 32. By relieving the outer wall 32 as such, the bolster will no longer become proturbed at the contact area 200, thereby protecting bolster 80 from failures of the type described.

Figure 6:
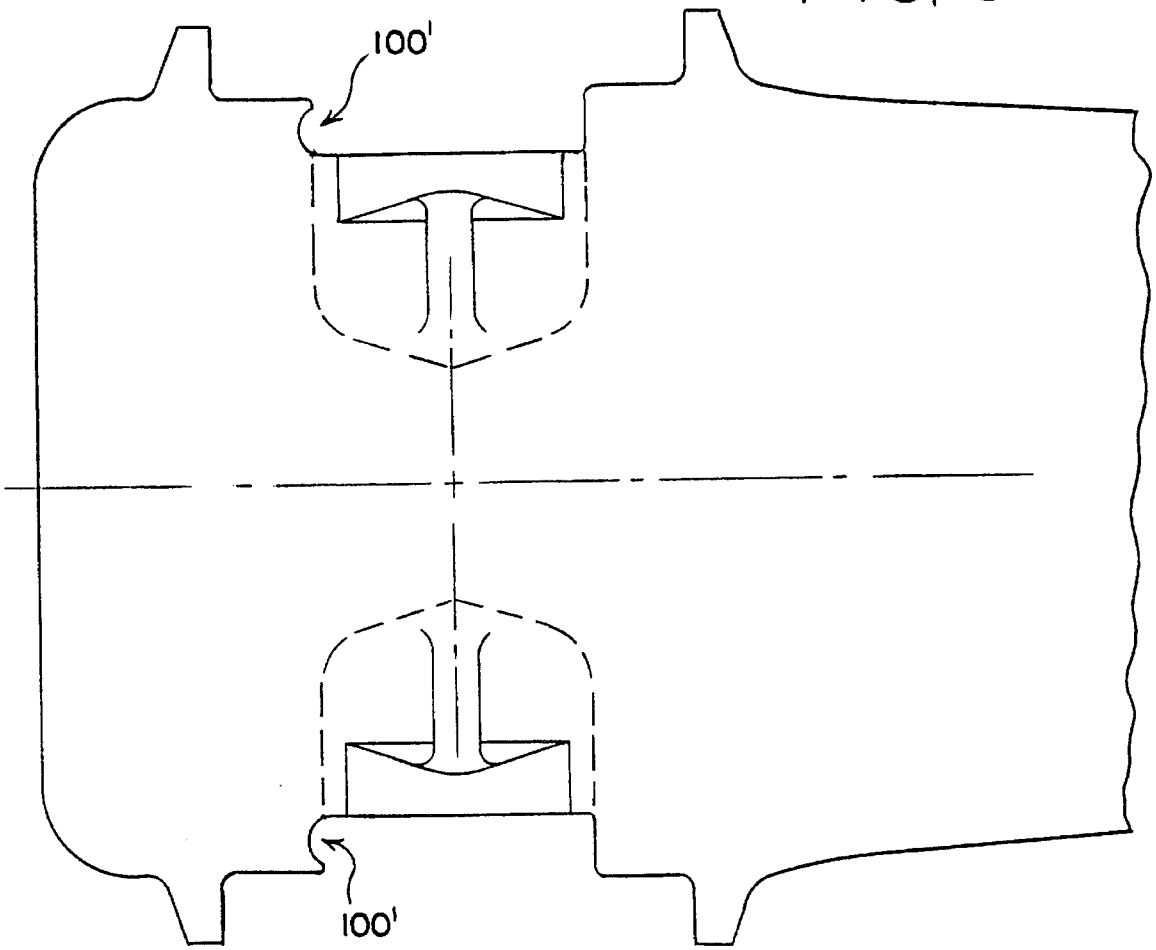
FIG. 6 is a plan view of a bolster of the present invention showing the relieved outer friction shoe pocket wall of another embodiment.
Figure 7:
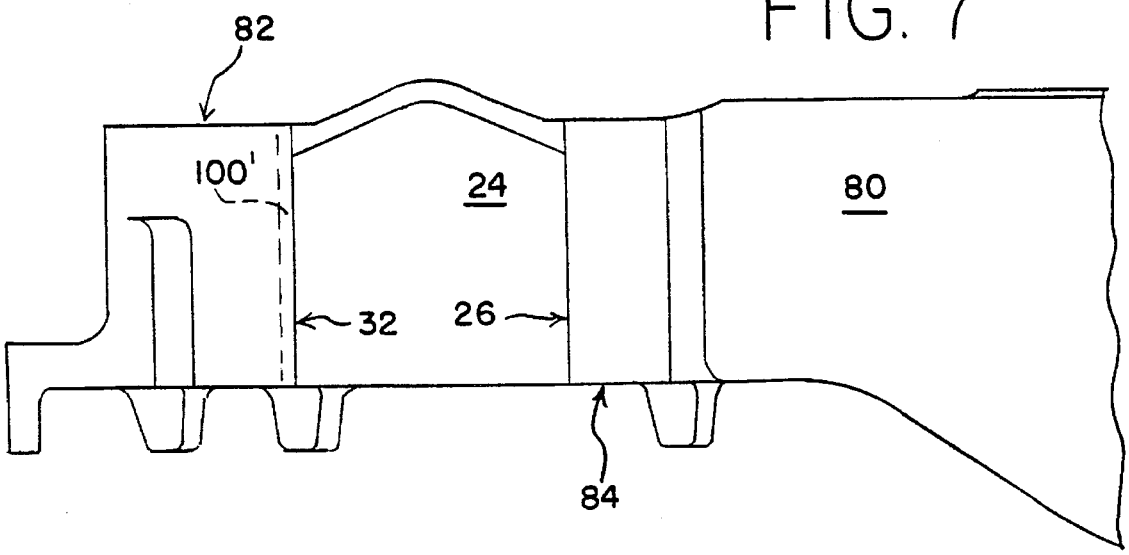
FIG. 7 is a side view of a bolster of the present invention showing the vertical extent of relieved section of the outer friction shoe pocket wall of another embodiment.

In a second embodiment illustrated in FIGS. 6 and 7, the vertically oriented indentation 100' coexists with the contact area 200. More particularly, indentation 100' is shaped hemispherically and has a depth into outboard sidewall 32 of at least 0.50 inches. Unlike the preferred embodiment, indentation 100' extends the full vertical extent 34 of the sidewall 32. As friction shoe corner 62 contacts area 200, indentation 100', the corner is received within the hemispherical indentation temporarily, until the friction shoe returns to its regular position. During the time in which corner 62 is received within indentation 100', there could be some contact between the outboard wall surface defining the hemispherical shape and corner 62, but this contact now occurs along the vertical height of the shoe/sidewall interface, thereby distributing some of the impact forces to the part of the vertical wear wall 36 closest to corner 62. The vertically oriented indentation 100' is not limited to a hemispherical shape, and can be a triangular shaped indentation formed into the outboard wall 32 on the opposing friction shoe pocket 20. However, if a triangularly shaped indentation is used, it has been found that it is preferable to make the legs of the triangle of equal extent.

As mentioned earlier, with any of the embodiments thus disclosed, it is preferable that the indentations be formed by casting them as such instead of machining them.

The foregoing description has been provided to clearly define and completely describe the present invention. Various modifications may be made to the disclosed embodiment without departing from the scope and spirit of the invention, defined in the following claims.

We claim:

1. In a railway truck bolster having a longitudinal axis which is transverse to a set of railroad rails, a friction shoe pocket for accommodating a wedge-shaped friction shoe therein, said friction shoe pocket comprising:

a sloped rear wall which extends between a top wall and a bottom wall of said bolster, said rear wall located longitudinally inward from a bolster sidewall and comprised of a pair of joined surfaces;

a first and inboard sidewall depending from said rear wall and extending to said bolster sidewall, thereby forming a first sidewall front edge, said first sidewall front edge having a vertical extent defined by the distance between said bolster top and bottom walls;

a second and outboard sidewall depending from said rear wall and extending to said bolster sidewall, thereby forming a second sidewall front edge, said second sidewall front edge having a vertical extent defined by the distance between said bolster top and bottom walls;

each of said sidewalls laterally spaced from said longitudinal axis and each other and cooperating with said rear wall to define a top and an open bottom of said friction shoe pocket, a variable rate friction shoe received in said friction shoe pocket, said variable rate friction shoe having a first planar side face, a second planar side face, and a sloped wedge surface, which said first and second planar side faces and said sloped wedge surface respectively engage said inboard and outboard sidewalls and said sloped rear wall of said friction shoe pocket, said first and second planar side faces interconnecting with a vertical wear surface on said friction shoe to form a respective inboard front corner and an outboard front corner;

said second and outboard sidewall provided with an indentation extending from said friction shoe pocket rear wall to said second sidewall front edge, said indentation positioned to prevent said friction shoe outboard front corner from impacting said friction shoe pocket outboard sidewall during rotation and translation of said shoe relative to said bolster, thereby preventing the formation of protuberances on an upper extent of said bolster outboard sidewall, said upper extent defined as the distance from said bolster top wall to a vertical midpoint between said bolster top and bottom walls, said indentation characterized by a taper, said taper beginning at about said outboard sidewall midpoint and extending upwardly to said bolster top wall, said taper having a gradual increase from about said midpoint to said top wall such that said outboard sidewall has a convex profile, wherein said indentation extends from said friction shoe pocket rear wall to said friction shoe pocket second front edge.

2. The bolster friction shoe pocket of claim 1 wherein said indentation extends from said bolster sidewall to a midpoint between said pocket rear wall and said outboard sidewall.

3. The friction shape of said shoe pocket of claim 1 wherein said indentation has a hemi-circular shape, said indentation located approximate to said second sidewall front edge and vertically extending from said bolster top wall to said bolster bottom wall.

4. The friction shoe pocket of claim 1 wherein said indentation has a triangular shape, said indentation located approximate to said second sidewall front edge and vertically extending from said bolster top wall to said bolster bottom wall, said triangular shape defined by a first leg having a first extent and a second leg having a second and equal extent.

* * * * *